US006116850A

United States Patent [19]

Yu

[11] Patent Number: 6,116,850

[45] Date of Patent: Sep. 12, 2000

[54] AUTOMOTIVE FUEL PUMP WITH A HIGH EFFICIENCY VAPOR VENTING SYSTEM

[75] Inventor: Dequan Yu, Ann Arbor, Mich.

[73] Assignee: Visteon Global Technologies, Inc., Dearborn, Mich.

[21] Appl. No.: 09/292,220

[22] Filed: Apr. 16, 1999

[51] Int. Cl.[7] ..... F04D 5/00

[52] U.S. Cl. ..... 415/55.1; 415/169.1

[58] Field of Search ..... 415/55.1, 55.2, 415/55.3, 55.4, 55.5, 55.6, 55.7, 169.1

[56] References Cited

U.S. PATENT DOCUMENTS

| | | | |
|---|---|---|---|
| 2,015,200 | 9/1935 | Spoor | 415/55.1 |
| 4,298,912 | 11/1981 | Dearth . | |
| 4,591,311 | 5/1986 | Matsuda et al. . | |
| 5,284,417 | 2/1994 | Yu . | |
| 5,330,319 | 7/1994 | Yu et al. . | |
| 5,449,269 | 9/1995 | Frank et al. . | |
| 5,580,213 | 12/1996 | Woodward et al. . | |
| 5,662,455 | 9/1997 | Iwata et al. . | |
| 6,010,301 | 1/2000 | Oi et al. | 415/55.2 |

FOREIGN PATENT DOCUMENTS

| | | |
|---|---|---|
| 61-0175297 | 8/1986 | Japan . |

*Primary Examiner*—Christopher Verdier
*Attorney, Agent, or Firm*—Mark L. Mollon

[57] ABSTRACT

An electric-operated fuel pump assembly (20) has a vaned impeller (36) that is disposed within a pump housing (28) for rotation about an axis (22). A channel (44; 72) extend arcuately about the axis. A vapor vent hole (46; 46A) intersects the channel. Certain geometric relationships improve venting efficiency, and hence pump efficiency.

10 Claims, 2 Drawing Sheets

AUTOMOTIVE FUEL PUMP WITH A HIGH EFFICIENCY VAPOR VENTING SYSTEM

BACKGROUND OF THE INVENTION

1) Field of the Invention

This invention relates an impeller pump useful as an electric-motor-operated fuel pump for an automotive vehicle to pump liquid fuel from a fuel tank through a fuel handling system to an engine that powers the vehicle. More particularly, the invention relates to improvements in vapor venting efficiency that improve pump efficiency.

2) Background Information

In an automotive vehicle that is powered by an internal combustion engine, fuel may be pumped through a fuel handling system of the engine by an in-tank, electric-motor-operated fuel pump. Various features for improving the efficiency of such pumps are known in the art. One of those features is a vent hole for venting liquid entrained vapor from the pumping chamber of the pump.

Examples of various vapor venting systems in pumps are shown in various patents, including U.S. Pat. Nos. 4,591,311; 5,284,417; 5,330,319; 5,580,213; 5,662,455; and JA 0175297.

U.S. Pat. No. 4,591,311 shows an impeller pump whose pumping chamber comprises a channel having a length that runs circumferentially about the main axis of the pump. An inlet to the channel and an outlet from the channel are in excess of 270° apart about the pump axis. A vapor vent hole extends out of the pumping chamber through a side wall of the pump casing parallel to the pump axis. The vent hole is spaced angularly from the inlet at an end of an upstream portion of the channel that has a larger cross sectional area than a following downstream portion of the channel that leads to the outlet. The vent hole intersects the channel just ahead of a step in the radially inner wall of the channel that demarcates the larger upstream portion from the smaller downstream portion.

U.S. Pat. No. 5,284,417 shows a pumping chamber channel having a vapor vent hole extending through a side wall of the pump casing parallel to the pump axis. The vent hole is spaced angularly from an inlet at an end of an upstream portion of the channel. As the upstream portion of the channel approaches the vent hole, the portion of its cross section that is enlarged relative the cross section of its downstream portion progressively contracts in the radial direction, providing a tapering transition to the vent hole.

SUMMARY OF THE INVENTION

Through the continuing development of such pumps, it has been discovered that certain novel geometries that relate the vent hole to the channel can produce meaningful improvements in pump efficiency. Those novel relationships are the subjects of the present invention.

One general aspect of the present invention relates generally to a pump comprising: a pump housing comprising a walled internal pumping channel extending arcuately about a main axis; a fluid inlet to, and a fluid outlet from, the pumping channel spaced arcuately apart about the axis; and a pumping element that is disposed within the housing for rotation about the axis and has a vaned periphery that is operable within the pumping channel for pumping fluid from the inlet to the outlet when the pumping element is rotated; the channel having an upstream portion that extends from the inlet and is followed by a downstream portion extending to the outlet; the upstream portion having a larger cross sectional area than the downstream portion; a vent hole for venting liquid-entrained vapor from the channel while the pumping element is being rotated to pump fluid from the inlet to the outlet; the vent hole extending from the surface of a wall that forms one axial boundary of the channel, through that wall, and out of the housing; the vent hole having an entrance that intersects the surface of the wall at the downstream portion of the channel beyond a ramp in the surface of the wall that demarcates the downstream portion of the channel from the upstream portion of the channel; the pumping element having a surface that confronts the surface of the wall as the pumping element rotates; a zone of that pumping element surface being spaced axially from the entrance of the vent hole a distance Z; the ramp having a beginning that is spaced from a center of the vent hole a distance L; and the ratio of Z to L being no greater than 1.5.

Another general aspect relates to a pump comprising: a pump housing comprising a walled internal pumping channel extending arcuately about a main axis; a fluid inlet to, and a fluid outlet from, the pumping channel spaced arcuately apart about the axis; and a pumping element that is disposed within the housing for rotation about the axis and has a vaned periphery that is operable within the pumping channel for pumping fluid from the inlet to the outlet when the pumping element is rotated; the channel being axially bounded by axial walls comprising axially facing wall surfaces, each of which confronts a respective axially facing zone of the pumping element as the pumping element rotates; a vent hole for venting liquid-entrained vapor from the channel while the pumping element is being rotated to pump fluid from the inlet to the outlet; the vent hole extending from the wall surface of one of the axial walls, through the one axial wall, and out of the housing; the vent hole having an entrance that intersects the wall surface of the one axial wall at a location that is between the inlet and the outlet; the channel having an axial dimension as measured between the axially facing wall surfaces that progressively uniformly decreases along the channel in the direction from the inlet to the outlet such that the wall surface of the one axial wall occupies a plane that is non-perpendicular to the axis and such that there is a difference, $\delta d$, between the axial dimension across the channel proximate the inlet and the axial dimension across the channel proximate the outlet; the length of the channel that provides the difference $\delta d$ has a dimension L; and the ratio of $\delta d$ to L is no greater than 20 to 1000.

Other general and more specific aspects will been set forth in the ensuing description and claims.

BRIEF DESCRIPTION OF THE DRAWINGS

The drawings that will now be briefly described are incorporated herein to illustrate a preferred embodiment of the invention and a best mode presently contemplated for carrying out the invention.

DESCRIPTION OF THE PREFERRED EMBODIMENT

Figure 1:
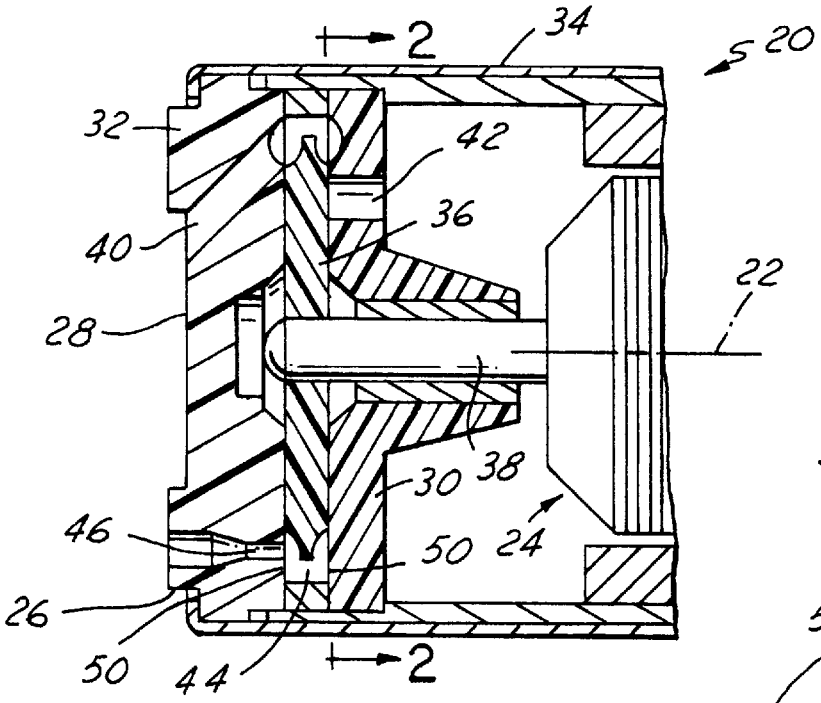
FIG. 1 is a longitudinal cross section view of a portion of an automotive fuel pump assembly embodying a pump in accordance with principles of the invention.

FIG. 1 shows an automotive vehicle fuel pump assembly 20 having an imaginary main axis 22 and comprising an electric motor 24 and a regenerative pump 26 embodying principles of the present invention. Pump 26 comprises a walled housing 28 that includes a pump bottom 30 and a pump cover 32 cooperatively arranged to close off one axial end of a cylindrical sleeve 34 and to cooperatively define an internal chamber within which a pumping element 36 is disposed for rotation about axis 22. The opposite axial end of sleeve 34 does not appear in the drawing, but is closed by a part that contains an exit via which fuel exits fuel pump assembly 20. Motor 24 comprises an armature including a shaft 38 journaled for rotation about axis 22 and having a keyed connection at one end for imparting rotational motion to pumping element 36.

Pump 20 is intended to be at least partially submerged in a fuel tank of an automotive vehicle for running wet. A passage that extends through pump cover 32 provides a pump inlet 40, and a passage that extends through pump bottom 30 provides a pump outlet 42. Fuel that leaves outlet 42 passes through motor 24 to exit pump assembly 20 at the opposite end from whence the fuel is pumped to an engine through an engine fuel handling system (not shown).

An example of a suitable construction for pumping element 36 is a molded plastic part of fuel- and wear-resistant material, such as a glass-filled phenolic for example, that comprises a circular body having a series of circumferentially spaced apart vanes around its outer periphery. As pumping element 36 is rotated by motor 22, its vaned periphery is effective to create a pressure differential between inlet 40 and outlet 42 that draws fuel into inlet 40, moves the fluid through the pump, and forces the fluid out of outlet 42.

Housing 28 comprises a main channel 44 extending arcuately about axis 22. One portion of the channel is defined by pump bottom 30 to one axial side of pumping element 36, and another by pump cover 32 to the other axial side of pumping element 36. Channel 44 may have a circumferential extent of more than 270°, but less than 360°.

Figure 2:
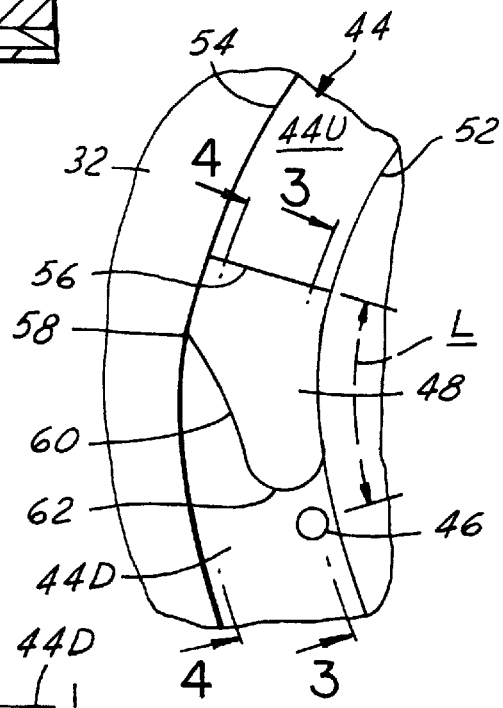
FIG. 2 is a fragmentary enlarged view in the direction of arrows 2—2 in FIG. 1 to illustrate a first embodiment.

A region of interest insofar as the present invention is concerned is a portion of channel 44 intermediate inlet 40 and outlet 42, as shown by FIG. 2 for the portion of channel 44 defined by pump cover 32. Except for the presence of a vapor vent hole 46 and of distinctive geometries at the channel's opposite ends where inlet 40 and outlet 42 intersect the channel, the portion of channel 44 in pump bottom 30 is essentially symmetrically opposite the portion shown in FIG. 2. In the region of interest to the invention, FIG. 2 shows a ramp 48 in pump cover 32. Pump bottom 30 has a symmetrically opposite ramp 48. Channel 44 has parallel, axially facing wall surfaces 50 that extend between circular cylindrical, radially inner and radially outer wall surfaces 52, 54 respectively. Except for the distinctive geometries at the channel's opposite ends because of inlet 40 and outlet 42 intersecting the channel, the radial dimension between wall surfaces 52 and 54 is uniform along the length of the channel. However, in an upstream portion 44U of channel 44 that is upstream of ramps 48, the axial dimension between wall surfaces 50 is greater than that between the same wall surfaces along a downstream portion 44D of channel 44 that is downstream of ramps 48. Thus, the cross sectional area of channel 44 radial to axis 22 is larger in upstream portion 44U than in downstream portion 44D. Ramps 48 are circumferentially co-extensive with a transition region between upstream and downstream channel portions 44U, 44D.

Figure 3:
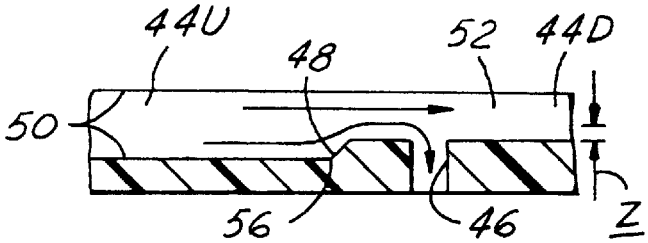
FIG. 3 is a fragmentary enlarged view, not necessarily to scale, in the direction of arrows 3—3 in FIG. 2.
Figure 4:
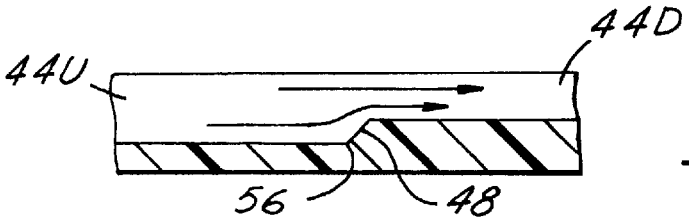
FIG. 4 is a fragmentary enlarged view, not necessarily to scale, in the direction of arrows 4—4 in FIG. 2.

In FIG. 2, ramp 48 is inclining out of the plane of the sheet toward the reader along a uniform slope in the counterclockwise direction, as suggested by the cross section view of FIG. 3. The ramp begins at a radial plane marked 56. Along an initial portion of its length extending from plane 56, ramp 48 has a uniform radial dimension equal to the spacing between wall surfaces 52 and 54. At a location 58, the ramp also begins narrowing in the radial sense, particularly along its radially outer edge 60. Ramp 48 ends as a curved edge 62 that adjoins downstream portion 44D of channel 44, just short of vent hole 46. The surface of the transition region that appears in FIG. 2 radially outwardly of edge 60 lies in the same plane as the portion of axially facing wall surface 50 in downstream channel portion 44D, as suggested by the cross section view of FIG. 4.

Vapor vent hole 46 is a circular hole (approximately 1 mm diameter is a representative size) extending from wall surface 50, through pump cover 32, and out of housing 28. Vent hole 46 has an entrance that intersects wall surface 50 at downstream portion 44D of channel 44 beyond ramp 48. It has been discovered that certain geometric relationships can provide improved vapor venting efficiency which leads in turn to improved pump efficiency.

Pumping element 36 has a surface zone that confronts the vent hole entrance as the pumping element rotates. That pumping element surface being spaced axially from the entrance of the vent hole a certain distance, which may be identified by the arbitrary letter Z. The beginning of ramp 48 at plane 56 is spaced from the center, or axis, of vent hole 46 a distance, which may be identified by the arbitrary letter L. Improved efficiency is obtained by making the ratio of Z to L no greater than 1.5. In a particular pump, best efficiency was found to occur when the ratio of Z to L is substantially 0.1.

Figure 5:
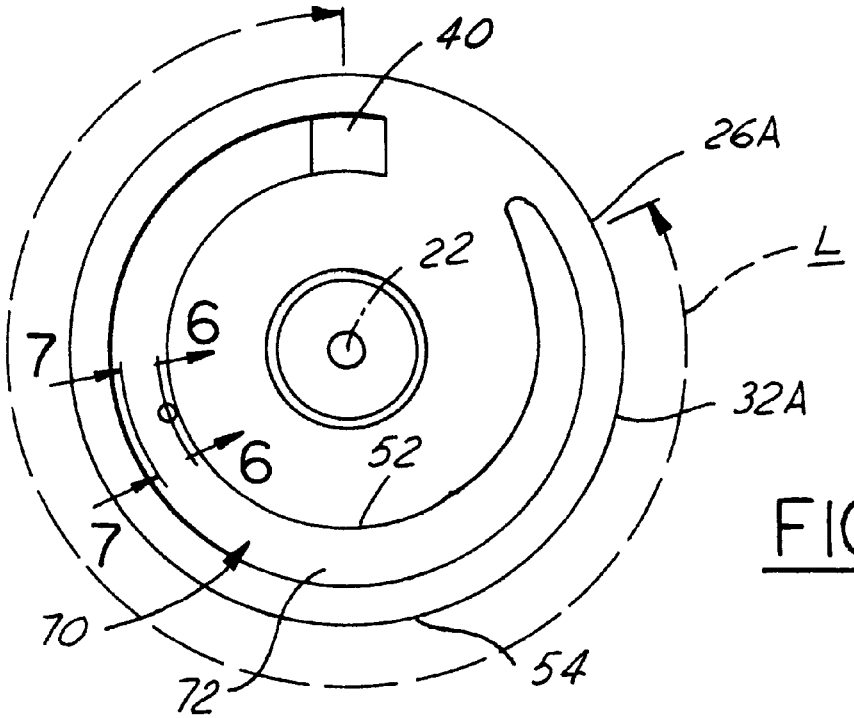
FIG. 5 is a full view in the same direction as the view of FIG. 2, but of a second embodiment.
Figure 6:
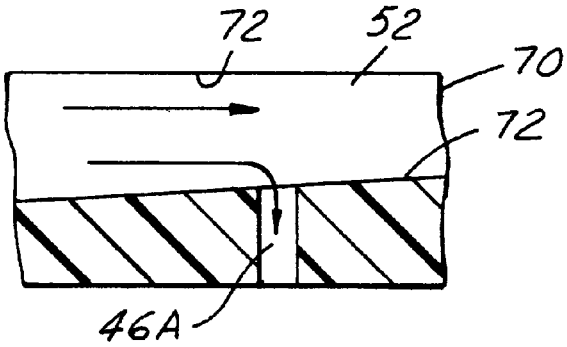
FIG. 6 is a fragmentary enlarged view, not necessarily to scale, in the direction of arrows 6—6 in FIG. 5.
Figure 7:
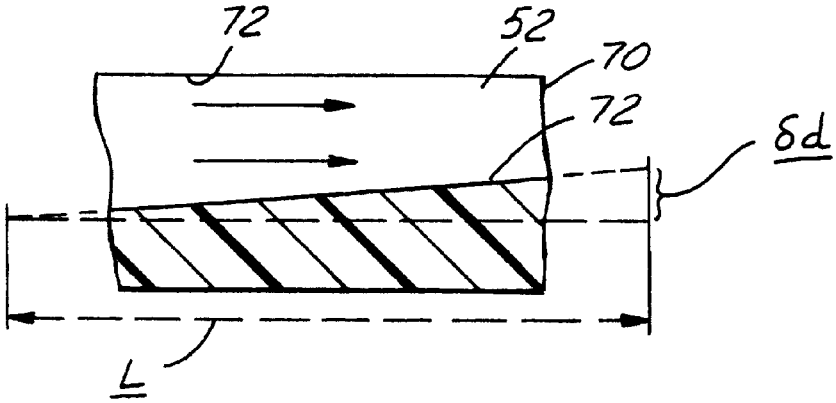
FIG. 7 is a fragmentary enlarged view, not necessarily to scale, in the direction of arrows 7—7 in FIG. 5.

FIGS. 5, 6, and 7 relate to a second embodiment of pump assembly 20A which is like pump assembly 20 except for having a somewhat different pump 26A. Pump 26A has a pump cover 32A and a pump bottom that enclose a pumping element 36 that is rotated by electric motor 24. A walled internal pumping channel 70 extends arcuately about main axis 22, and inlet 40 and outlet 42 are spaced arcuately apart.

Channel 70 may be referred to as a converge channel. It is axially bounded by axial walls comprising axially facing wall surfaces 72, each of which confronts a respective axially facing zone of pumping element 36 as the pumping element rotates. A vent hole 46A vents liquid-entrained vapor from channel 70 while pumping element 36 is being rotated to pump fluid through the channel. Vent hole 46A extends from the wall surface 72 of pump cover 32A, through pump cover 32A, and out of the pump housing. Vent hole 46A has an entrance that intersects wall surface 72 at a location that is between the pump inlet and outlet.

Channel 72 is referred to as a converge channel because it has an axial dimension as measured between the axially facing wall surfaces that progressively uniformly decreases along the channel in the direction from the inlet to the outlet such that the wall surface of one axial wall, specifically wall surface 72 in pump cover 32A, occupies a plane that is non-perpendicular to axis 22 and such that there is a difference, δd, between the axial dimension across the channel proximate the inlet and the axial dimension across the channel proximate the outlet. The length of the channel providing that difference δd has a dimension L. For improved vapor venting and resulting pumping the ratio of δd to L is made no greater than 20 to 1000. In a particular pump, best efficiency was found to occur when the ratio of δd to L is substantially 6 to 1000.

The arrangements are believed to help the entrained fuel vapor to flow gradually and smoothly into the vent hole entrance. Improvements approximating 8% to 10% can result. Hot fuel handling is improved.

While a presently preferred embodiment has been illustrated and described, it is to be appreciated that the invention may be practiced in various forms within the scope of the following claims.

What is claimed is:

1. A pump comprising: a pump housing comprising a walled internal pumping channel extending arcuately about a main axis; a fluid inlet to, and a fluid outlet from, the pumping channel spaced arcuately apart about the axis; and a pumping element that is disposed within the housing for rotation about the axis and has a vaned periphery that is operable within the pumping channel for pumping fluid from the inlet to the outlet when the pumping element is rotated; the channel having an upstream portion that extends from the inlet and is followed by a downstream portion extending to the outlet; the upstream portion having a larger cross sectional area than the downstream portion; a vent hole for venting liquid-entrained vapor from the channel while the pumping element is being rotated to pump fluid from the inlet to the outlet; the vent hole extending from the surface of a wall that forms one axial boundary of the channel, through that wall, and out of the housing; the vent hole having an entrance that intersects the surface of the wall at the downstream portion of the channel beyond a ramp in the surface of the wall that demarcates the downstream portion of the channel from the upstream portion of the channel; the pumping element having a surface that confronts the surface of the wall as the pumping element rotates; a zone of that pumping element surface being spaced axially from the entrance of the vent hole a distance Z; the ramp having a beginning that is spaced from a center of the vent hole a distance L; and the ratio of Z to L being no greater than 1.5.

2. A pump as set forth in claim 1 in which the ratio of Z to L is substantially 0.1.

3. A pump as set forth in claim 1 in which the vent hole is circular and the vent hole axis is parallel to the main axis of the pump.

4. A pump as set forth in claim 3 in which the ramp has a uniform slope in the circumferential direction.

5. A pump as set forth in claim 4 in which the ramp also has a radial dimension that progressively decreases along the circumferential extent of the ramp in a direction from the beginning of the ramp.

6. A pump as set forth in claim 1 in which the pump is a fuel pump for pumping volatile liquid fuel in an automotive vehicle fuel system, and further including an electric motor comprising a shaft having a driving association with the pumping element for rotating the pumping element about the axis.

7. A pump comprising: a pump housing comprising a walled internal pumping channel extending arcuately about a main axis; a fluid inlet to, and a fluid outlet from, the pumping channel spaced arcuately apart about the axis; and a pumping element that is disposed within the housing for rotation about the axis and has a vaned periphery that is operable within the pumping channel for pumping fluid from the inlet to the outlet when the pumping element is rotated; the channel being axially bounded by axial walls comprising axially facing wall surfaces, each of which confronts a respective axially facing zone of the pumping element as the pumping element rotates; a vent hole for venting liquid-entrained vapor from the channel while the pumping element is being rotated to pump fluid from the inlet to the outlet; the vent hole extending from the wall surface of one of the axial walls, through the one axial wall, and out of the housing; the vent hole having an entrance that intersects the wall surface of the one axial wall at a location that is between the inlet and the outlet; the channel having an axial dimension as measured between the axially facing wall surfaces that progressively uniformly decreases along the channel in the direction from the inlet to the outlet such that the wall surface of the one axial wall occupies a plane that is non-perpendicular to the axis and such that there is a difference, δd, between the axial dimension across the channel proximate the inlet and the axial dimension across the channel proximate the outlet; the length of the channel that provides the difference δd has a dimension L; and the ratio of δd to L is no greater than 20 to 1000.

8. A pump as set forth in claim 7 in which ratio of δd to L is substantially 6 to 1000.

9. A pump as set forth in claim 7 in which the wall surface of the other axial wall occupies a plane that is perpendicular to the axis.

10. A pump as set forth in claim 7 in which the pump is a fuel pump for pumping volatile liquid fuel in an automotive vehicle fuel system, and further including an electric motor comprising a shaft having a driving association with the pumping element for rotating the pumping element about the axis.

* * * * *